United States Patent [19]

Span

[11] Patent Number: 4,606,731

[45] Date of Patent: Aug. 19, 1986

[54] BUBBLE PIPE

[76] Inventor: Samuel Span, c/o Span Products, Inc., 93 Belmont Ave., Paterson, N.J. 07509

[21] Appl. No.: 625,031

[22] Filed: Jun. 27, 1984

[51] Int. Cl.[4] ..... A63H 33/28

[52] U.S. Cl. ..... 446/19; 40/408

[58] Field of Search ..... 446/15, 16, 17, 18, 446/19, 20, 21; 40/408

[56] References Cited

U.S. PATENT DOCUMENTS

| | | | |
|---|---|---|---|
| 650,323 | 5/1900 | Horton . | |
| 650,324 | 5/1900 | Horton . | |
| 814,890 | 3/1906 | Tacy | 40/408 |
| 1,020,708 | 3/1912 | Marshall . | |
| 1,155,470 | 10/1915 | Crossman | 446/20 |
| 1,550,057 | 8/1925 | Beeler | 40/408 |
| 2,305,382 | 12/1942 | Hagopian . | |
| 2,398,513 | 4/1946 | Bradley | 446/15 |
| 3,443,337 | 5/1969 | Ehrlich . | |
| 4,467,552 | 8/1984 | Jernigan | 446/15 |

*Primary Examiner*—F. Barry Shay

*Attorney, Agent, or Firm*—Jacobs & Jacobs

[57] ABSTRACT

A bubble pipe, which comprises a hollow tubular member having first and second open ends, a mouthpiece closing said first end and having an orifice therein communicating with the interior of said hollow member, said second end being adapted to support a film of a bubble solution thereacross, and a film divider at the second end for dividing the film of bubble solution carried by the second end, the cross-sectional area of the opening at said second end being about sixteen times the cross-sectional area of said mouthpiece.

9 Claims, 6 Drawing Figures

FIG. 1
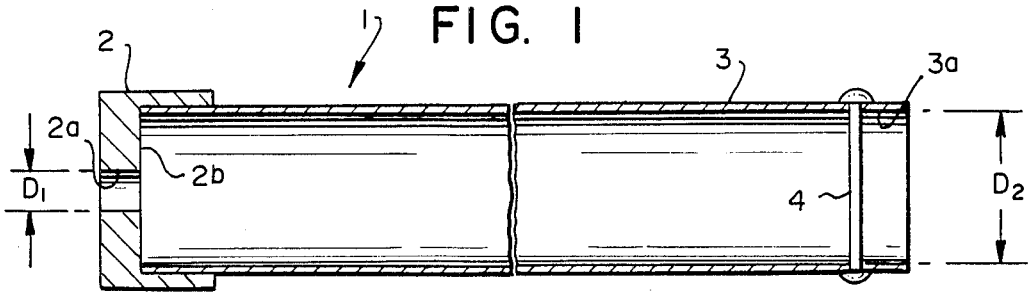
FIG. 2
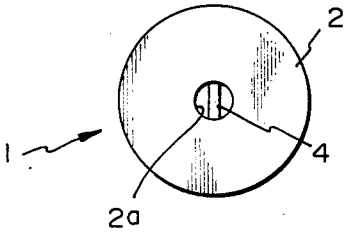
FIG. 3
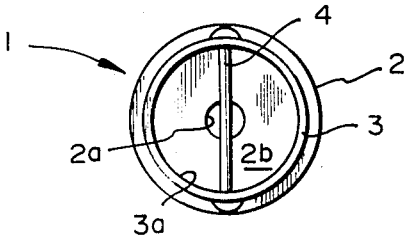
FIG. 4
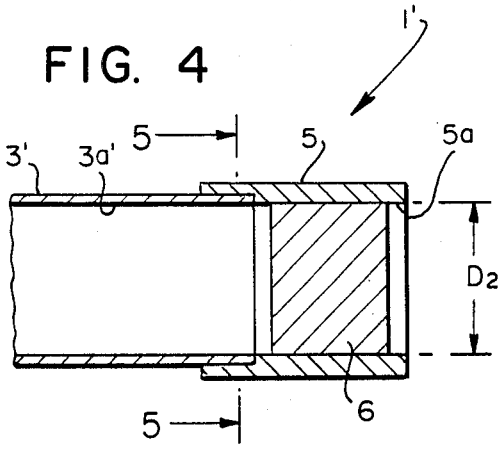
FIG. 5
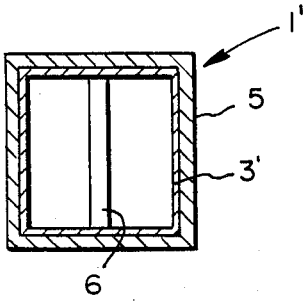
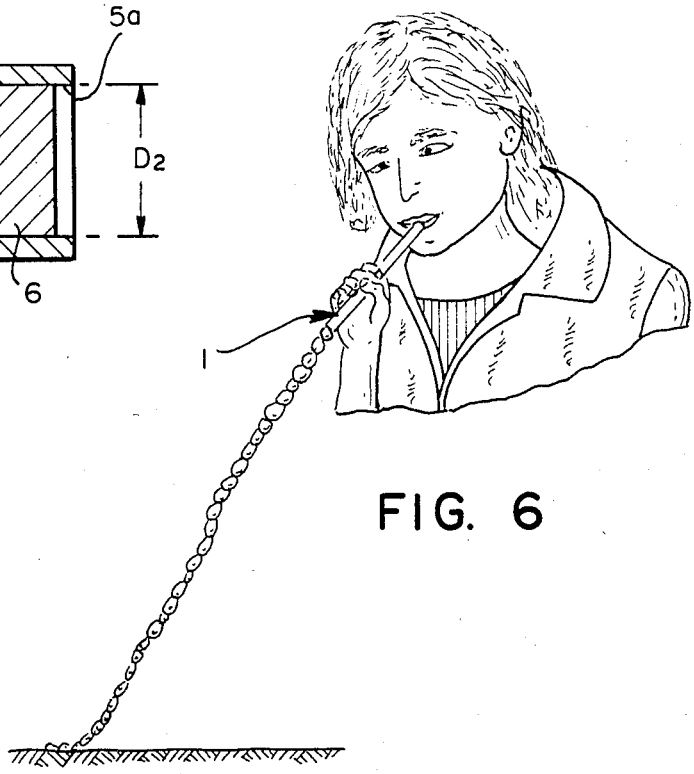
FIG. 6

BUBBLE PIPE

The present invention relates to a bubble pipe and more particularly to a bubble pipe that is capable of producing a chain of interconnected bubbles of great length.

As is well known, it sometimes occurs that small bubbles formed through the use of common bubble pipes or bubble tubes will fuse together to form a large bubble cluster. These clusters generally are of spherical form and break after they reach a critical size. Clusters of indefinite size are not obtained.

The present invention provides a bubble pipe that is capable of producing a cluster of bubbles in the form of a longitudinally extending chain of fused bubbles of almost indefinte length. The bubble cluster formed by the bubble pipe of the present invention does not assume the generally spherical shape of bubble clusters formed by prior art bubble pipes, but rather comprises a chain of bubbles in which any given bubble is fused to only the bubble immediately ahead of it and behind it in the bubble chain.

Unexpectedly, this surprising result is achieved by providing a divider at the outlet of the bubble pipe and controlling the ratio of the area of the outlet of the bubble pipe to the area of the orifice of the mouthpiece of the bubble pipe.

In particular, the present invention provides a bubble pipe comprising a hollow tubular member having first and second open ends, a mouthpiece closing said first end and having an orifice therein communicating with the interior of said hollow member, said second end being adapted to support a film of a bubble solution thereacross, and film dividing means adjacent to and upstream of said second end for dividing the film of bubble solution carried by said second end, the cross-sectional area of the opening at said second end being about sixteen times the cross-sectional area of said mouthpiece.

The present invention is illustrated in terms of a preferred embodiment in the accompanying drawings, in which:

FIG. 1 is a side elevational view, in section, of a bubble pipe according to the invention;

FIG. 2 is a front elevational view of the bubble pipe of FIG. 1;

FIG. 3 is a rear elevational view of the bubble pipe of FIG. 1;

FIG. 4 is a partial view similar to FIG. 1 of an alternative embodiment of the invention;

FIG. 5 is a view in section, taken along lines 5—5 of FIG. 4; and FIG. 6 is a diagrammatic view of bubbles formed in a long chain using the bubble pipe according to the invention.

Referring to the drawing, FIG. 1 shows a bubble pipe 1 according to the invention having a mouthpiece 2 connected at one end to a hollow, cylindrical tube 3. The other end 3*a* of the hollow tube 3 is open and adjacent the open end 3*a* is a pin 4 passing through the hollow tube 3 and secured thereto. In use, the end 3*a* will be dipped into a conventional bubble solution, such as an aqueous soapy solution, well known for such purposes, and air will be blown by the user through the orifice 2*a* of the mouthpiece 2. During use, it appears that the pin 4 divides the film of soap solution (not shown) carried by the end 3*a* of bubble pipe 1 into two side-by-side films. Quite surprisingly, it has been found that a long chain of interconnected bubbles, as shown in FIG. 6 will be produced if the ratio of the diameter, $D_2$, of circular outlet end 3*a*, to the diameter $D_1$, of the circular orifice 2*a* is 4:1, such that the ratio of the cross-sectional area of outlet end 3*a* to the cross-sectional area of the orifice 2*a* is 16:1. While very slight deviations from this 16:1 ratio of cross-sectional areas of the outlet to the orifice can be tolerated, such as a range of from about 15.8:1 to about 16.2:1, other ratios do not give rise to the long chain of bubbles depicted in FIG. 6.

FIGS. 4 and 5 illustrate an alternative embodiment of the invention in which a hollow tube 3' of polygonal cross-section is employed, and specifically in which the hollow tube 3' presents a square cross-section. FIGS. 4 and 5 also illustrate the case where the bubble pipe 1' has an extension 5 secured to the end of the tubular member 3', the end 5*a* of the extension 5 being dipped into the bubble solution and carrying the film (not shown) of bubble solution from which bubbles are formed. Within extension 5 is an elongated divider 6, which serves the same function as the pin 4 of FIGS. 1–3, namely to divide the film of bubble solution carried by the end 5*a*. As in the case of bubble pipe 1, the cross-sectional area of the end 5*a* will be essentially equal to 16 times the area of the mouthpiece of bubble pipe 3'.

While it is preferred that the pin 4 or divider 6 be located in the middle of the airstream approaching the film of bubble solution carried by end 3*a* or 5*a*, deviations from the midpoint can be tolerated as long as the long chain illustrated in FIG. 6 is formed. The placement of pin 4 or divider 6, if not at the midpoint, will have to be empirically determined. Regardless of the form or shape of the film divider, it will divide the film into two films side-by-side. The air expands the films so that two bubbles are formed that are touching as in a FIG. 8. Gravity turns the FIG. 8 downwardly while at the same time another FIG. 8 is starting, attached to the first, thus forming a chain.

I claim:

1. A bubble pipe, which comprises a hollow tubular member having first and second open ends, a mouthpiece closing said first end and having an orifice therein communicating with the interior of said hollow member, said second end being adapted to support a film of a bubble solution thereacross, said bubble pipe including means for producing a single chain of more than three serially connected bubbles when the pipe is used, said chain-producing means comprising a film-dividing means at said second end wholly within said hollow tubular member for dividing said film of bubble solution supported by said second end and the cross-sectional area of the opening at said second end being about sixteen times the cross-sectional area of said orifice.

2. The bubble pipe according to claim 1, in which said hollow member is of circular cross-section.

3. The bubble pipe according to claim 1, in which said opening at said second end is of circular cross-section.

4. The bubble pipe according to claim 1, in which said opening at said second end is of polygonal cross-section.

5. The bubble pipe according to claim 1, in which said orifice is of circular cross-section and said opening at said second end is of circular cross-section.

6. The bubble pipe according to claim 1, in which said opening at said second end is of square cross-section.

7. The bubble pipe according to claim 1, in which said film divider means is a pin located transverse to the flow of air passing through said second end.

8. The bubble pipe according to claim 1, in which said film divider means is an elongated panel extending transversely across said flow of air through said second end.

9. The bubble pipe according to claim 1, in which said film divider means divides said film in half.

* * * * *